United States Patent [19]

Jung

[11] 3,951,571

[45] Apr. 20, 1976

[54] CONSTANT PRESSURE PUMP

[75] Inventor: Werner Jung, Morton Grove, Ill.

[73] Assignee: Teletype Corporation, Skokie, Ill.

[22] Filed: Aug. 26, 1974

[21] Appl. No.: 500,800

[52] U.S. Cl. ..... 417/328; 417/478

[51] Int. Cl.[2] ..... F04B 43/12; F04B 45/06

[58] Field of Search ..... 185/38; 417/328, 210, 417/437, 478

[56] References Cited

UNITED STATES PATENTS

| | | | |
|---|---|---|---|
| 1,762,890 | 6/1930 | Rogers | 417/328 |
| 2,059,803 | 11/1936 | Mann | 417/437 |
| 3,495,540 | 2/1970 | Edwards | 417/478 |

FOREIGN PATENTS OR APPLICATIONS

| | | | |
|---|---|---|---|
| 597,046 | 1/1948 | United Kingdom | 417/478 |
| 42,191 | 7/1954 | Germany | 417/478 |

*Primary Examiner*—William L. Freeh
*Attorney, Agent, or Firm*—W. G. Dosse; W. K. Serp; J. L. Landis

[57] ABSTRACT

A constant pressure pump in which a tube containing the fluid is squeezed between an anvil and a ram, the two surfaces of which are shaped so as to maintain the same area of contact between the ram and the tube in a plane substantially perpendicular to the motion of the ram during substantially the entire squeezing operation and wherein the collapsed portions of the tube are permitted to escape from the ram area into slots substantially parallel with the motion of the ram.

9 Claims, 9 Drawing Figures

CONSTANT PRESSURE PUMP

FIELD OF THE INVENTION

The present invention relates to pumps and more particularly to a pump for delivering a fluid at a constant pressure over a period of time.

BACKGROUND OF THE INVENTION

In a fluid transfer device or printer of the type disclosed in U.S. Pat. No. 3,500,436, granted on Mar. 10, 1970, R. W. Nordin, liquid ink is squirted from a nozzle under pressure and is charged and electrostatically deflected to form alphanumeric or graphical indicia on paper. In order to obtain uniform deflection responses in the electrostatic deflection field, the ink droplets must not only be charged to the appropriate voltages, but they must also be travelling at a well-defined, preferably-constant velocity. This requires that a constant pressure be applied to the fluid behind the nozzle orifice. Any variations in fluid pressure will result in variations of fluid velocity which will result in variations in deflection magnitude for the same deflection voltages. This constant pressure must be maintained preferably over the entire period during which copy is being printed on a page of paper.

Simple, constant-pressure pumps known to the art are readily available. For example, a centrifugal pump could be used, except that this would require that the fluid be exposed to the pump impeller and its numerous seals and connections with resultant risk of contamination and impurities which would tend to clog the minute orifice of the nozzle. Such nozzles are typically on the order of .0008 inch in diameter, or smaller. Also, the handling of such ink can be an exceedingly messy operation; and risk of leakage through faulty seals is unacceptable. Additionally, rapid changes up to the desired pressure and down to zero flow are desired so as to minimize messy ink dribble on "start up" and "stop" of the printer.

Pumps are well known wherein the fluid is located in a tubular container so that the container can be squeezed between a ram and an anvil. Such pumps are readily adaptable to pumping fluid at constant volume. An example of such a constant-volume pump is an artificial heart machine in which blood flows through a hose or tube. Two or more rollers squeeze the tube progressively much like the motion of manual milking of a cow. However, when trying to get constant pressure so as to obtain constant fluid velocity, difficulties are experienced with squeezing tube pumps. As the tube or container collapses, it exposes a greater and greater area of surface to the ram. This requires either complex driving mechanisms for the ram so as to accommodate this greater area with resultant greater force, or simply a lower pressure will result.

The body of the tube or container, as it is squeezed, must also be constrained from simply balloning much as an unconstrained automobile inner tube will expand locally without the constraint of the tire carcass and rim.

It is an object of the present invention to deliver a quantity of fluid under constant pressure with a minimum likelihood of contamination.

It is another object of the present invention to constrain a fluid container as it is being squeezed in order to pressurize its contents so as to prevent balloning of the walls of the container.

SUMMARY OF THE INVENTION

In accordance with the present invention, a ram is driven with a constant force toward an anvil squeezing a deformable resilient container therebetween for forcing fluid to issue therefrom, while maintaining a constant area of contact in a plane substantially perpendicular to the direction of motion of the ram.

BRIEF DESCRIPTION OF THE DRAWINGS

A more complete understanding of the present invention may be had by referring to the following detailed description when considered in conjunction with the accompanying drawings wherein like reference numbers denote the same or similar parts throughout the several views in which.

DETAILED DESCRIPTION

Figure 2:
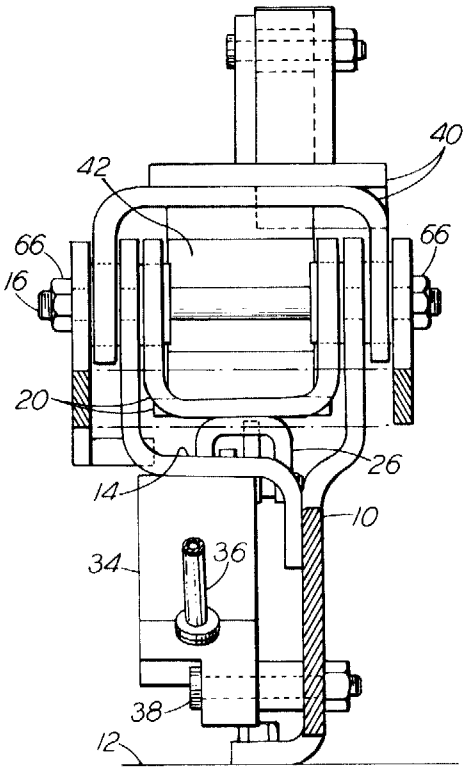
FIG. 2 is an end view partially in cross section taken along line 2—2 of FIG. 1.
Figure 1:
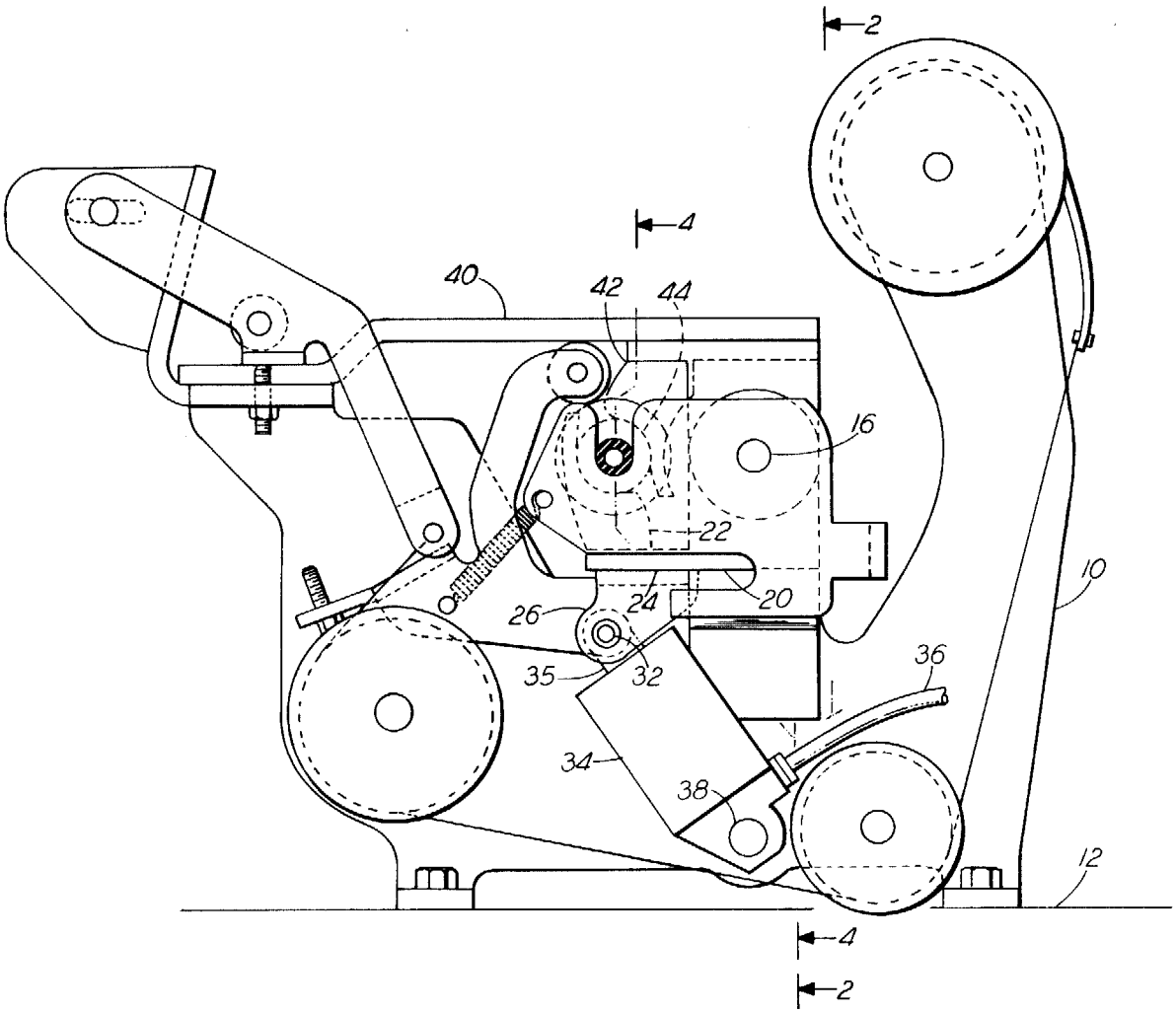
FIG. 1 is a side view of the pump mechanism showing it in the idle condition.

Referring now to FIGS. 1 and 2, a frame plate 10 is bolted to the base 12 of an ink jet printer which preferably uses an ink supply system disclosed in an application for U.S. patent, Ser. No. 500,819 in the name of W. Jung and K. E. Knuth, filed of even date herewith. An extension 14, best shown in FIG. 2, is firmly mounted to the frame plate 10 and supports one end of a pivot shaft 16, the other end of which is also supported in the frame plate 10. The entire pump mechanism pivots about the pivot shaft 16.

An anvil frame 20 is pivoted at each end on the pivot shaft 16. An anvil 22, shown in dotted lines in FIG. 1, is supported on the base 24 of the anvil frame 20. Therefore, in effect, the anvil 22 is capable of movement in an arcuate path about the pivot shaft 16.

A bifurcated arm 26 depends from the base 24 of the anvil frame 20 and carries a pivot shaft 32. A piston (not shown) within a hydraulic cylinder 34 carries a piston rod 35 that is rotatably mounted to the pivot shaft 32. A hydraulic line 36 connects the hydraulic cylinder 34 to a fluid drive mechanism which is explained more thoroughly hereinafter in connection with FIGS. 8 and 9. The hydraulic cylinder 34 is pivoted at a pivot 38, and when the hydraulic piston within the cylinder 34 moves the piston rod 35 outwardly, the anvil frame 20 rotates clockwise about the pivot shaft 16 so as to raise the anvil 22 in an arcuate path centered about the shaft 16.

A ram lever 40 is also pivoted about the pivot shaft 16 and carries with it a ram 42. When the ram lever 40 rotates counterclockwise about the shaft 16, the ram 42 cooperates with the anvil 22 to compress and squeeze a tube 44 therebetween so as to pump ink to the nozzle of an ink jet printing machine (not shown) also mounted on the printer base 12.

Figure 4:
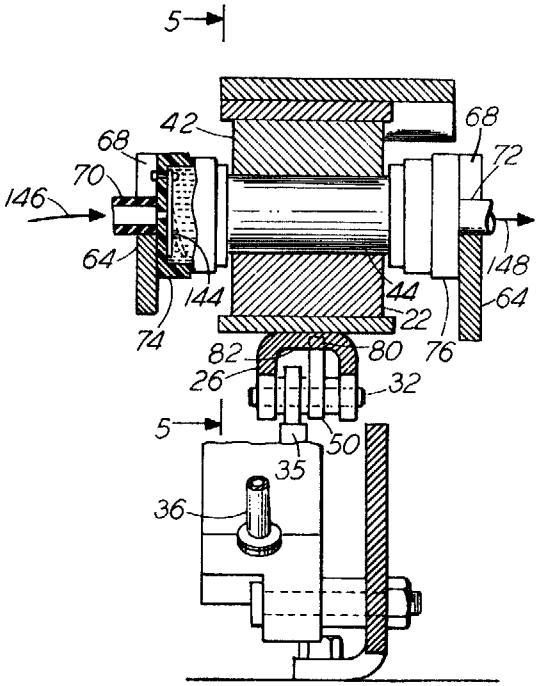
FIG. 4 is an end view partially in cross section taken along line 4—4 of FIG. 1.
Figure 3:
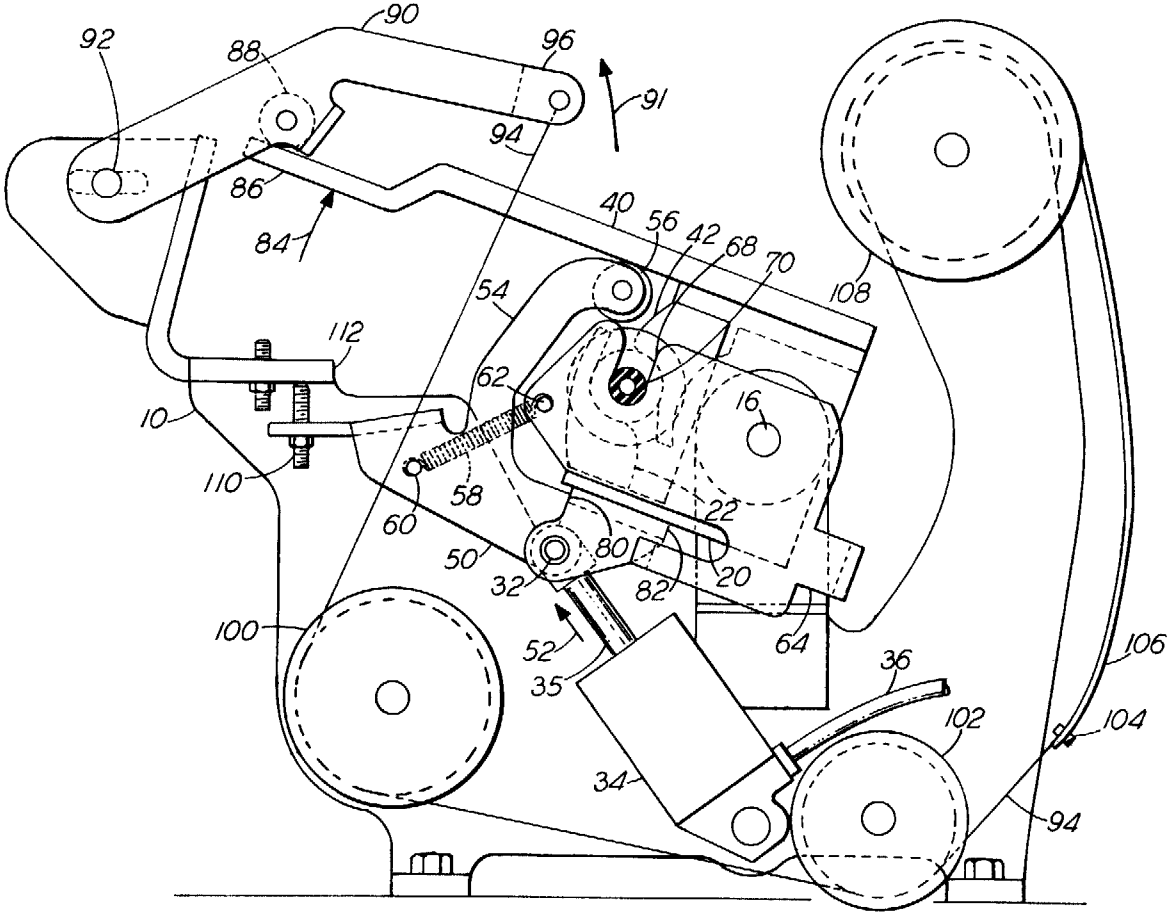
FIG. 3 is a side view showing the pump in the cocked condition.

Referring now to FIGS. 3 and 4, a lifting arm 50 is also pivotally mounted on the pivot shaft 32 and is thus carried axially with respect to the cylinder 34 upon movement of the piston rod 35 in the direction of the arrow 52. The lifting arm 50 has an extension 54 which carries a roller 56 that bears on the bottom surface of the ram lever 40. A light spring 58 applies a force between a spring post 60 on the lifting arm 50 and a shaft 62 in an axial constraint frame 64 which is also pivoted on the pivot shaft 16 and is further axially constrained by the nuts 66 (FIG. 2) on the threaded ends of the shaft 16.

The purpose of the axial constraint frame 64 is best illustrated in FIGS. 3 and 4 wherein a slot 68 at each side thereof accommodates the inlet hose 70 and the outlet hose 72 of the pump while preventing the inlet cap 74 and the outlet cap 76 of the tube 44 from expanding in the axial direction of the tube 44.

Referring again to FIG. 3, the spring 58 tends to hold the extension 54 of the lifting arm 50 in the position shown in FIGS. 1 and 3, in which a butt end 80 on the lifting arm 50 bears against the cross member 82 of the bifurcated arm 26 thereby limiting clockwise rotation of the lifting arm 50 about the pivot shaft 32. Consequently, as the piston rod 35 moves in the direction of the arrow 52, the anvil frame 20 rotates about the shaft 16 and the lifting arm 50 carries, via the roller 56, the ram lever 40, thereby maintaining the same relative positions between the ram 42 and the anvil 22 so as not to apply any pressure to the tube 44.

As the ram lever 40 ascends by rotating about the pivot shaft 16, in the direction of the arrow 84, the outer end 86 raises a roller 88 which is rotatably mounted to a spring lever 90. As the ram lever 40 is rotated clockwise about the pivot shaft 16, the spring lever 90 rotates counterclockwise about its own adjustable pivot 92 in the direction of the arrow 91. A cable 94 is attached to the outer end 96 of the spring lever 90 and counterclockwise rotation of the spring lever 90 causes the cable 94 to be pulled upwardly by the spring lever 90. The cable 94 passes over a pair of rollers 100 and 102 and is connected to the end 104 of the constant-force, coiled spring 106 which is wound on a reel 108. The end 104 of the constant-force spring 106 can also be wound on a reel as is commonly known in the art in which such springs are used to apply a constant force no matter what their deflection, within a broad range. Consequently, as the end 96 of the spring lever 90 is raised due to the clockwise rotation of the ram lever 40 about the pivot shaft 16, substantially a constant force or tension is applied through the cable 94.

Figure 5:
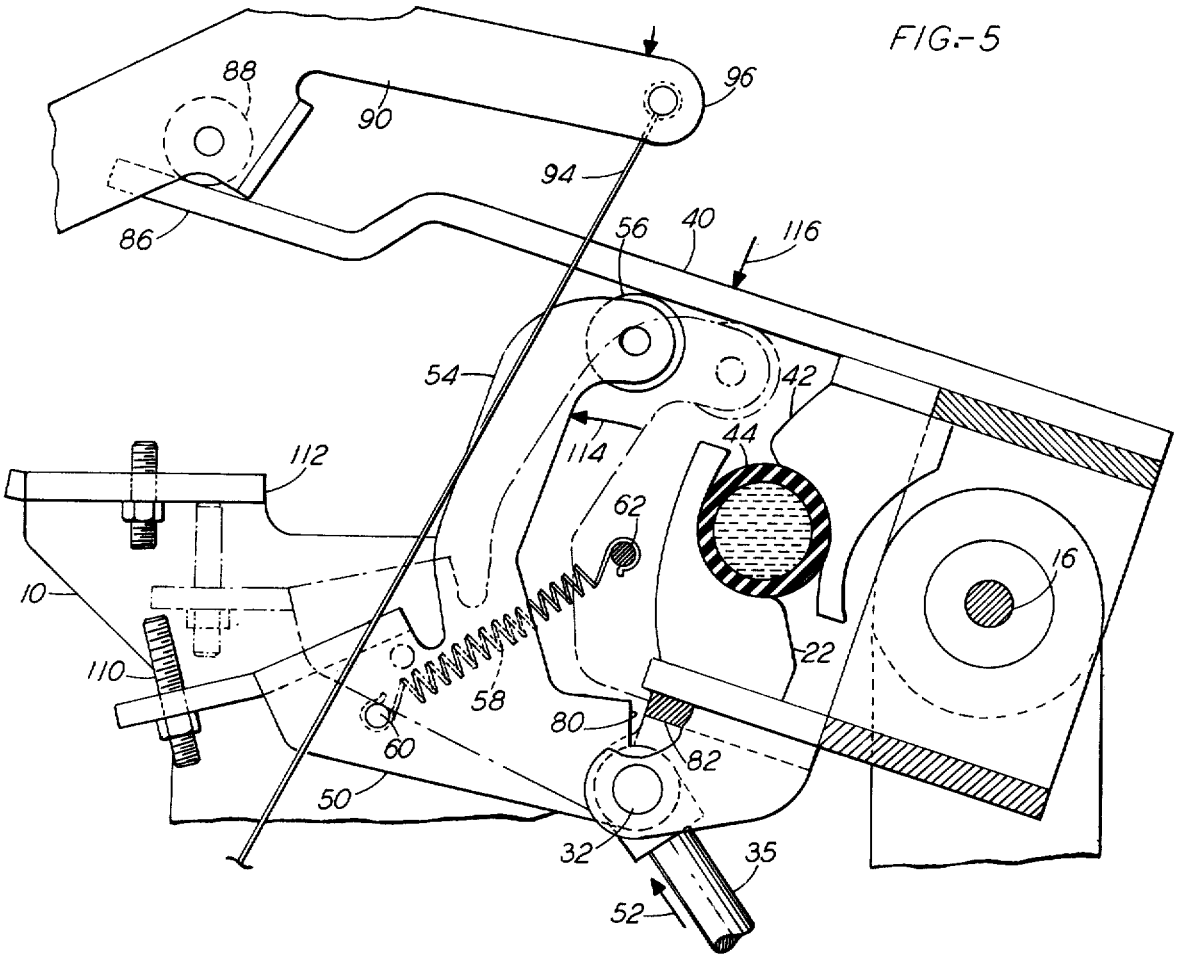
FIG. 5 is an enlarged view of a portion of the pump in the condition shown in FIG. 3 but illustrating the stripping function.

As illustrated best in FIGS. 3 and 5, when the lifting lever 50 reaches a predetermined position, an adjustment screw 110 strikes a stop bracket 112 on the frame plate 10. The lifting lever 50 then begins rotating counterclockwise in the direction of the arrow 114 (FIG. 5) about the point of contact between the screw 110 and the bracket 112 and also pivots at the pivot shaft 32 against the urging of the light spring 58. When the lifting lever 50 rotates counterclockwise, the roller 56 at the end of the extension 54 moves in the direction of the arrow 114 in FIG. 5. When the roller 56 moves far enough in the direction of the arrow 114, it overcenters and thus releases the lever 40 for downward movement under the ultimate urging of the tension in the cable 94. When the roller 56 overcenters, the lever 40 can push the roller 56 further to the left as the lever 40 descends, in spite of the tension on the light spring 58. This permits the ram lever 40 to move down in the direction of an arrow 116 in FIG. 5 under the urging of the constant tension in the cable 94, which causes the roller 88 to bear on the outer end 86 of the ram lever 40.

The lifting lever 50 has been shown in solid lines and in phantom in FIG. 5 to illustrate how the ram lever 40 is released for downward motion. The illustration of the lifting lever 50 in phantom lines in FIG. 5 illustrates its locked position during the lifting operation in which the butt end 80 is in engagement with the cross member 82 so as to lift the ram lever 40 when the piston rod 35 moves in the direction of the arrow 52. However, when the adjustment screw 110 strikes the stop bracket 112, the light spring 58 is quickly overcome and the roller 56 and the lever 50 are quickly overcentered. The force of the ram lever 40 against the roller 56 quickly drives the roller 56 the rest of the way to the left and practically no resistance is then provided by the lifting arm 50 to the downward motion of the ram lever 40. In this way, a sudden but even pressure is applied by the ram 42 at the instant that the roller 56 is stripped away but not before.

Figure 6:
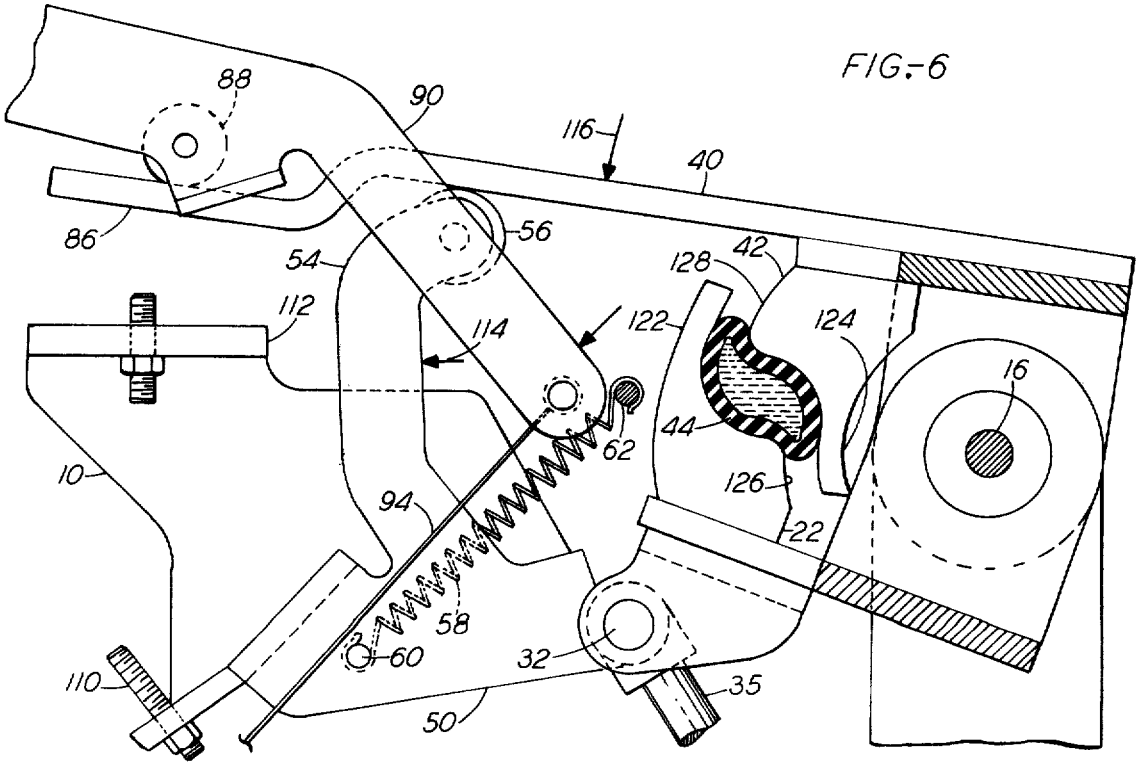
FIG. 6 is an enlarged view of the same portion of the pump shown in FIG. 5 but illustrating a condition midpoint in the cycle of the pump.
Figure 7:
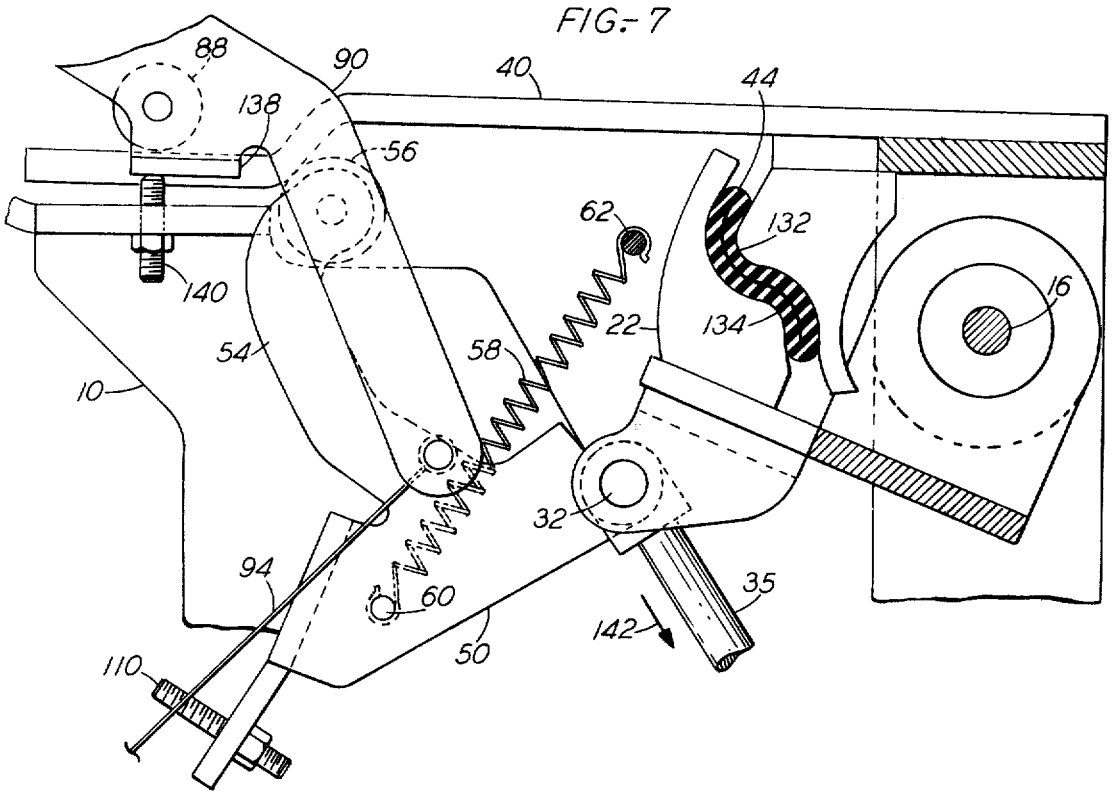
FIG. 7 is an enlarged view of the same portion of the pump shown in FIGS. 5 and 6 but illustrating a condition near the end of the cycle of the pump.

Referring now to FIGS. 5, 6, and 7, a progression is illustrated in which three stages of compression of the tube 44 are illustrated. FIG. 5 shows the instant of the beginning of the pressure inside the tube 44 at which the ram 42 is applying downward pressure on the tube in cooperation with the anvil 22. At the instant that the lifting lever 50 overcenters, the full pressure of the ram 42 is suddenly applied to the tube 44 with an absolute minimum of prior downward acceleration thereby reducing pressure overshoot but quickly bringing the pressure up to the desired quantity dependent upon the force on the cable 94 and the leverage system formed by the spring lever 90 and the ram lever 40.

As the ram 42 descends, the anvil 22 is held in position by the piston rod 35, which is in turn held motionless during the period when the ram 42 descends. Specifically, in FIG. 6 the ram lever 40 rotates counterclockwise about the pivot shaft 16 and the ram 42 squeezes the tube 44 in such a way that the extra material of the tube 44 extends into two slots formed by an extension 122 on the anvil 22 and an extension 124 on the ram 42. The extensions 122 and 124 are generally arcuate in shape and the arcs formed by these extensions have curvatures centered about the pivot shaft 16. In addition, a side 126 and a side 128 on the anvil 22 and the ram 42, respectively, are also curved in shape centered about the pivot shaft 16 so as to form with their respective extensions 124 and 122, an arcuate slot centered about the pivot shaft 16 into which slots the excess material of the tube 44 can migrate as the tube is squeezed. At all times, the area of contact between the tube 44 and the ram 42 is arranged in such a way that a projection in a plane passing through the axis of the pivot shaft 16 always contains substantially the same area thereby applying substantially the same force per unit area on the body of the tube 44 which constant force per unit area is, of course, transmitted to the fluid contained within the tube 44.

FIG. 7 illustrates the terminal end of the squeezing of the tube 44. While the tube 44 is shown in FIG. 7 as being completely collapsed or wrung out, in actual practice it would be desirable to terminate the operation of the printer before the tube reaches this completely collapsed condition. However, FIG. 7 illustrates the cooperation of the shapes of the ram and anvil. It will be noted in FIG. 5 that the anvil 22 and the ram 42 have a configuration comprising a radius of concave curvature substantially identical to the outside diameter of the cylindrical tube 44. It will be further noted in FIG. 7 that the ram and anvil both contain heels 132 and 134, each having a convex radius of curvature equal to the abovementioned concave radius of curvature less twice the thickness of the tube 44.

Referring again to FIG. 7, the spring lever 90 contains a stop bracket 138 which at the terminal portion of the movement of the ram lever 40 engages a stop screw 140 to prevent further motion of the ram lever 40. During the normal operation of the printer, it is desirable to terminate the operation of the pump, and the operation of the printer just prior to the time that the bracket 138 engages the stop screw 140 and such engagement is provided as a safety feature.

In order to discontinue the pressure and reset the pump at the end of a cycle of operation, the piston rod 35 is moved in the direction of an arrow 142 (FIG. 7) which immediately drops the bracket 138 into engagement with the screw 140 and thus simultaneously removes the pressure of the ram 42 from the tube 44 and stops the flow of ink from the nozzle of the ink jet printer. Movement of the piston rod 35 in the direction of the arrow 142 also drops the anvil 22 from the position shown in FIG. 7 to the position shown in FIG. 1. When the ram force is removed from the tube 44, it draws ink from a larger reservoir through the inlet hose 70 of FIG. 4. The tube 44 thus refills through a one-way valve which is illustrated by a flap 144 in FIG. 4. The flap 144 permits fluid to flow only in the direction of the arrows 146 and 148 in FIG. 4. A similar one-way valve can be provided elsewhere in the ink system to prevent movement of ink from the nozzle to fill the tube 44. However, the nozzle orifice diameter is so small that capillary action within the nozzle orifice itself is generally sufficient to prevent retrograde movement of ink.

Figure 8:
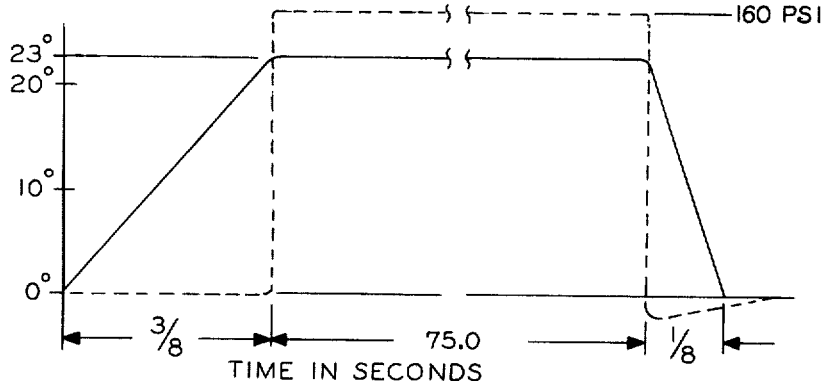
FIG. 8 is a timing diagram of pump operation.
Figure 9:
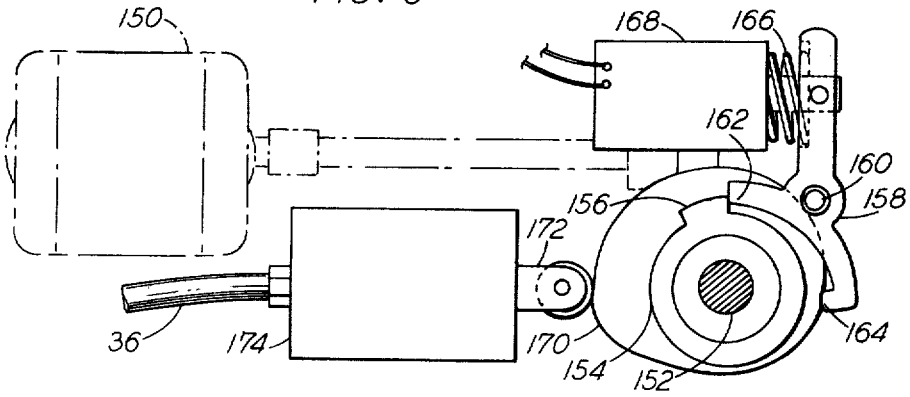
FIG. 9 illustrates the mechanism for driving the pump of FIG. 1.

One cycle of operation of the pump is illustrated in the timing diagram of FIG. 8 which is best considered in conjunction with FIG. 9 wherein the mechanism is shown for operating the hydraulic cylinder 34. A motor 150 drives through a constant force clutch or coupling of some well known type such as magnetic or felt friction coupling or even a spring clutch or other single rotation clutch to drive a shaft 152. A clutch plate 154 carries a stop tab 156. A stop arm 158 is 20 mounted on a pivot 160 such that when the stop arm 158 pivots counterclockwise about the pivot 160, its end 162 engages the stop tab 156 as illustrated in FIG. 9. When the stop arm 158 rotates clockwise about the pivot 160, the end 162 is disengaged from the stop tab 156 allowing the shaft 152 to rotate until the stop tab 156 engages another end 164 of the stop arm 158. The other end 164 of the stop arm 158 is preferably positioned 90° away from the end 162, with reference to the rotation of the clutch plate 154.

Therefore, when the stop arm 158 is positioned as shown illustratively in FIG. 9, the clutch plate 154 is held in the position shown in FIG. 9. When the stop arm 158 is rotated clockwise about the pivot 160 (for example, by a spring 166) the clutch plate 154 rotates through 90° in the clockwise direction until it engages the end 164. The clutch plate 154 is then stopped by the end 164 and held until the stop arm 158 is again rotated counterclockwise about the pivot 160.

A solenoid magnet 168 is preferably used to accomplish the counterclockwise rotation of the stop arm 158. The magnet 168 is energized at the instant at which a sheet of paper is inserted into the printer, thereby releasing the clutch plate 154 from the end 164 and permitting it to rotate through approximately 270° at the beginning of a printing cycle of the machine. When a page of paper has been printed, the solenoid magnet 168 is deenergized and the spring 166 causes the end 162 to disengage from the stop tab 156 permitting the clutch plate 154 to rotate the last 90° of its cycle to its initial position.

The clutch plate 154 carries with it a plate cam 170 which is so configured as to drive a piston rod 172 to the left in FIG. 9 during the 270° of rotation from the end 164 clockwise to the end 162. The plate cam 170 is further configured so as to permit the piston rod 172 to move to the right during the last 90° of the cycle of the clutch plate 154 as the stop tab 156 moves from the end 162 to the end 164. The piston rod 172 is connected to a piston (not shown) within a cylinder 174 which is hydraulically connected via the hydraulic line 36 to the hydraulic cylinder 34. If a spring-type or single-rotation-type clutch is used to drive the cam 170, the clutch plate 154 is not firmly fastened to the cam 170 but serves merely as a stop collar to control the engagement and disengagement of the clutch which in turn drives the cam 170.

Therefore, at the start of a page the solenoid magnet 168 is energized to release the stop tab 156 from the end 164 and permit the plate cam 170 to drive the piston rod 172 to the left in FIG. 9 so as to drive the piston rod 35 (FIG. 3) in the direction of the arrow 52 (FIG. 5) until the stop tab 156 (FIG. 9) strikes the end 162. This 270° of rotation of the shaft 152 requires about three-eighths of a second as illustrated in the left-most portion of a timing curve of FIG. 8. During the 270° rotation of the cam 170 the anvil 22 (FIG. 3) is elevated through approximately 23° of rotation about the pivot shaft 16. Thereafter, for about 75 seconds in the typical ink jet printer, the anvil 22 is maintained at this 23° position during which time a sheet of paper is printed. At the end of the approximately 75 seconds the magnet 168 is de-energized and the spring 166 frees the tab 156 from the end 162 and the piston rod 172 moves to the right in FIG. 9. The rightward movement of the rod 172 requires approximately one-eighth of a second as illustrated in the right-most end of the timing curve of FIG. 8.

Referring to the pressure curve in FIG. 8, which is shown in dotted lines, the pressure on the tube 44 remains at substantially zero pressure for approximately three-eighths of a second while the ram lever 40 is raised after which time the ram lever 40 is released by the lifting arm 50. When the ram lever 40 is thus released, the pressure rapidly rises to approximately 160 psi in the preferred embodiment, as illustrated by the dotted lines in FIG. 8. The pressure remains at substantially 160 psi while the ram lever 40 slowly drives the ram 42 into the tube 44 until such time as the magnet 168 is de-energized and the anvil 22 begins to descend. As soon as the anvil 22 descends, the stop bracket 138 strikes the screw 140 and the pressure immediately drops to some negative value at which partial vacuum ink is drawn in the direction of the arrow 146 in FIG. 4 through the inlet hose 70 from a large reservoir supply (not shown).

Referring now to FIGS. 5, 6, 7, and 8, FIG. 5 illustrates the instant of the sharp pressure rise illustrated in FIG. 8 at the beginning of the 75-second interval. FIG. 6 illustrates a condition somewhere in the middle of the 75-second interval of FIG. 8. FIG. 7 illustrates substantially the right-hand end of the pressure curve at which the pressure drops from 160 psi to some negative value when the bracket 138 strikes the screw 140 preferably the cam 170 causes the anvil 22 to descend upon deenergization of the magnet 168.

Although a particular embodiment of the invention is shown in the drawings and has been described in the foregoing specification, it is to be understood that other modifications of this invention, varied to fit particular operating conditions will be apparent to those skilled in the art and the invention is not to be considered limited to the embodiment chosen for purposes of disclosure, and covers all changes and modifications which do not constitute departures from the true scope of the invention.

What is claimed is:

1. A constant-pressure liquid pump including:

an anvil;

a ram mounted for movement in a path toward and away from the anvil;

a deformable, resilient container having an exit port and positioned between the anvil and the ram;

means for substantially constraining the liquid leaving the container to flow only through the exit port;

the anvil and the ram so shaped as to present, perpendicular to the path of movement of the ram, a substantially constant area of contact with the resilient container;

means for applying substantially a constant-force to the ram including a constant-force spring; and said applying means further comprises means for moving the ram and anvil together against the urging of the spring and means for releasing the ram for movement toward the anvil under the urging of the spring.

2. A constant-pressure fluid pump wherein an elongated tube having a predetermined wall thickness and containing the fluid is squeezed between a ram and an anvil in which the ram moves along a path toward and away from the anvil, the improvement wherein;

the ram defines a surface positioned in engagement with the tube said ram surface having a curvature matching the curvature of the tube when substantially filled with fluid; and a projection on the ram extending generally in the direction of movement of the ram and positioned for contact with the outer surface of the tube said projection being spaced from the anvil by a distance equal to substantially twice the wall thickness of the tube for constraining tube material as the fluid is forced from the tube.

3. A pump according to claim 2 wherein the anvil defines a projection having a convex surface for engaging the tube as it empties said anvil surface mating with the surface defined by the ram and having the same degree of curvature as the surface of the ram less twice the wall thickness of the tube for constraining the tube wall as the fluid exits from the tube;

a second surface defined by the anvil for engagement with the tube said second anvil surface having a curvature matching the curvature of the tube when substantially fitted with fluid.

4. In a pump for delivering a fluid under constant pressure:

a flexible, resilient container having a wall of preselected thickness for containing a quantity of the fluid to be delivered;

an anvil having a shape matching at least a portion of the shape of the container;

a ram having a shape matching at least a portion of the shape of the container and for movement in a path toward and away from the anvil to squeeze the container;

a projection from the anvil extending generally parallel with the path of movement of the ram and displaced from the ram;

a projection from the ram extending generally in the direction of the path of movement of the ram and displaced from the anvil;

a constant force spring for driving the ram toward the anvil with substantially a constant force;

means for extending said spring prior to the application of force to the ram including means for moving the anvil and ram together to an end position against the urging of said spring; and means for releasing the ram for movement of the spring.

5. A constant-pressure liquid pump including:

an anvil;

a ram mounted for movement along a path toward and away from the anvil;

a deformable, resilient container having an exit port, said container being positioned between the anvil and the ram;

means for substantially constraining the liquid leaving the container so as to direct liquid flow only through the exit port;

the anvil and the ram being so shaped as to present, perpendicular to the path of movement of the ram, a substantially constant area of contact with the resilient container throughout the path of movement of the ram; and means for applying a substantially constant force tto said ram. to

6. A pump according to claim 5 wherein said container is a deformable resilient elongated tube having a longitudinal axis and a preselected wall thickness; and means for restraining the ends of said tube to prevent substantial axial expansion of said tube.

7. A pump for delivering a fluid under constant pressure comprising:

a flexible, resilient elongated tube having a preselected wall thickness and serving to contain a quantity of fluid to be delivered, the axis of said tube being oriented generally in the direction of fluid flow therethrough;

means for constraining the tube to prevent substantial expansion in an axial direction;

an anvil having a shape matching at least a portion of the outer surface of the tube and having a projection for progressive engagement with the surface of the tube and serving to squeeze the tube, said projection extending generally parallel with the path of movement of the anvil;

a ram having a shape matching at least a portion of the shape of the tube and having a projection for progressive engagement with the surface of the tube and serving to squeeze the tube, said projection extending generally parallel with the path of movement of the ram, the ram and anvil being so shaped that the area of contact between the ram and the tube in a surface projection perpendicular to the path of movement of the ram remains substantially constant throughout compression of the tube.

8. A pump according to claim 7 wherein said ram projection is displaced throughout its path of movement from the anvil by a distance equal to substantially twice the wall thickness of the tube.

9. A pump according to claim 7 wherein said anvil projection is displaced throughout its path of movement from the ram by a distance equal to substantially twice the wall thickness of the tube.

* * * * *